United States Patent [19]

Wright

[11] 4,243,259

[45] Jan. 6, 1981

[54] PET FECES PICK-UP DEVICE

[75] Inventor: Ralph J. Wright, Emeryville, Calif.

[73] Assignee: Rita M. Dixon, Emeryville, Calif.

[21] Appl. No.: 13,127

[22] Filed: Feb. 21, 1979

[51] Int. Cl.[3] ..... A01K 29/00; A47L 13/52

[52] U.S. Cl. ..... 294/1 B

[58] Field of Search ..... 294/1 B, 1 BB, 1 BA, 294/19, 55; 15/104.8, 257.1, 257.2, 257.7, 257.9; 119/1 R

[56] References Cited

U.S. PATENT DOCUMENTS

| | | | |
|---|---|---|---|
| 3,767,247 | 10/1973 | Wetzler | 294/1 B |
| 3,942,831 | 3/1976 | Sosnuve | 294/1 BA |
| 3,977,715 | 8/1976 | Casci | 294/1 BA |

*Primary Examiner*—James B. Marbert

*Attorney, Agent, or Firm*—Warren, Chickering & Grunewald

[57] ABSTRACT

A device for easy, clean and sanitary picking up and disposal of pet feces, the device being a trough-like member having opposed sides and dimensioned for insertion into the open end of a bag with the bag draped over the sides to define a concave fece receiving area; and means on the member remote from the open end of the bag for tentatively securing the bag to the member while the open bag end is engaged and rolled back on itself to an inverted bag position containing within the bag feces deposited on the prepared area of the bag.

7 Claims, 6 Drawing Figures

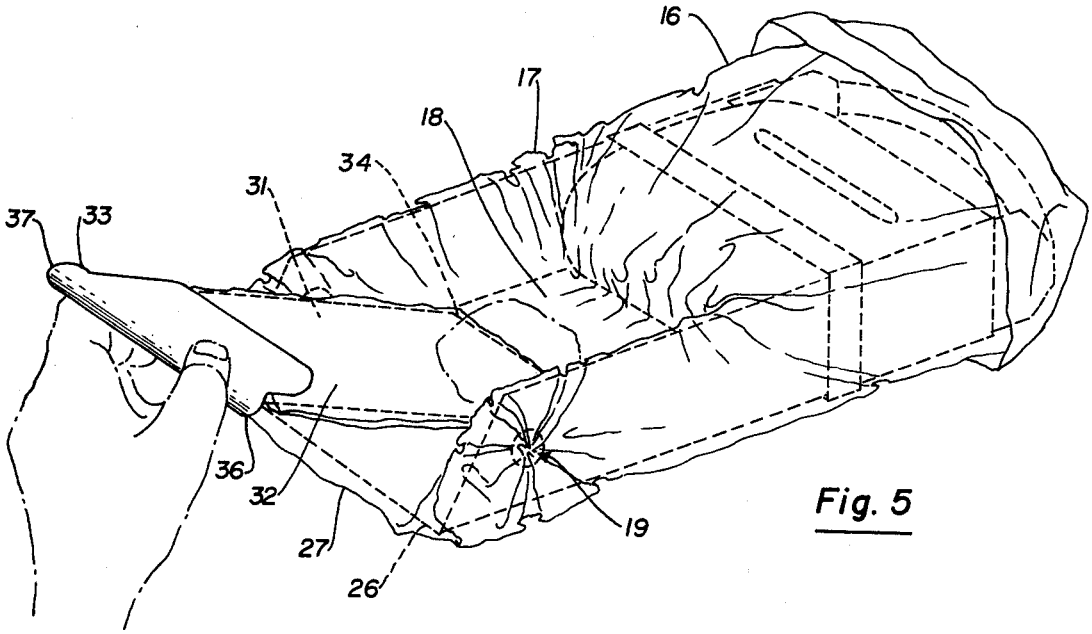
Fig. 5
Fig. 6
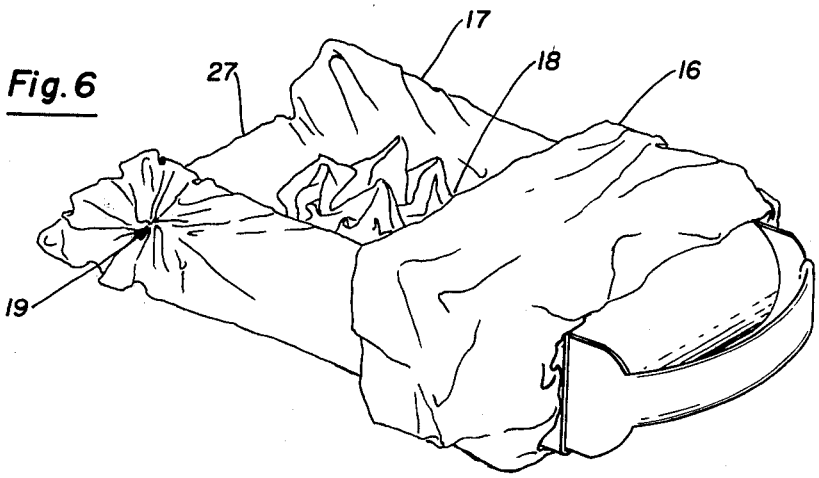

PET FECES PICK-UP DEVICE

BACKGROUND OF THE INVENTION

The invention relates to devices designed to assist in the picking up and disposal of animal feces and the like.

The presence of pet droppings, particularly dog feces, on public sidewalks, walkways, gutters, and planted areas has been an unsightly, unsanitary and otherwise troublesome nuisance, and the required cleaning up of affected areas is most frequently looked upon as an obnoxious and annoying task. Increasingly, the matter has become one of public concern and ordinances have been passed to compel pet owners to be responsible for the picking up and disposal of their pet droppings. While certain types of tools have been offered to pet owners for this purpose, none, insofar as Applicant is aware, is constructed in accordance with the present invention.

SUMMARY OF THE INVENTION

An object of the present invention is to provide a pet feces pick-up device of the character described which will afford an easy, clean, and sanitary pick up and disposal of pet feces.

Another object of the present invention is to provide a device of the character above which is of lightweight, compact and readily portable structure for ready carrying about, as for example while walking the pet, and affords an attractive carrying case with its contents totally concealed.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

BRIEF DESCRIPTION OF THE DRAWINGS

FIG. 5 is a perspective view of the device in one position of its operation.

FIG. 6 is a perspective view of the device in another position of its operattion.

DETAILED DESCRIPTION OF THE INVENTION

Figure 1:
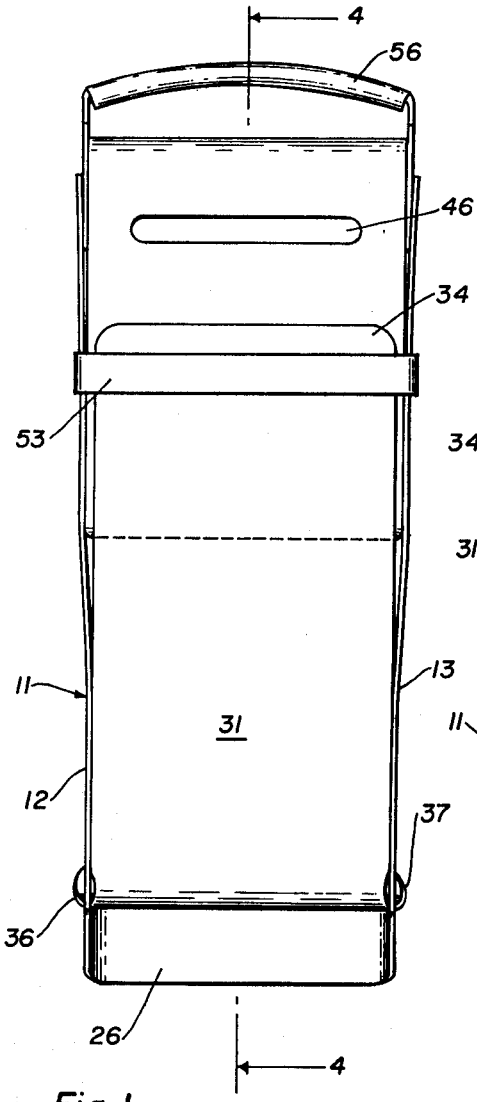
FIG. 1 is a front elevation of a pet feces pick-up device constructed in accordance with the present invention.

The pet feces pick-up device of the present invention comprises, briefly, a trough-like member 11 having opposed sides 12 and 13 dimensioned for insertion into the open end 16 of a bag 17, see FIGS. 5 and 6, with the bag draped over sides 12 and 13 to define a concave fece-receiving area 18; and means 19 remote from the open end of the bag for securing the bag to member 11 while the open bag end 16 is engaged and rolled back on itself to an inverted position of the bag, see FIG. 6, to contain internally within the bag feces 21 deposited on area 18. Preferably, and as here shown, means 19 comprises finger-size openings 22 and 23 formed in sides 12 and 13 for frictionally retaining bag portions pushed, as by one of the user's fingers, into the openings. The retention of the bag portions within openings 22 and 23 is tentative but sufficient to permit the rolling back of the bag to its inverted position, as above noted, with the bag portions retained within the openings being released from the device as the inversion of the bag is completed.

Preferably, and in accordance with the present invention, member 11 is formed with an open end 22 defining a scoop for receiving feces, and bag retaining openings 22 and 23 are positioned in sides 12 and 13 adjacent end 26. Accordingly, when end 26 of the member is inserted in bag 17 with end 26 moved to the closed end or bottom 27 of the bag, release of the bag portions from openings 23 will not be effected by manual withdrawal of the bag from member 11 until the bag is substantially completely inverted.

Another feature of the present invention is the provisions of a plate-like member 31 which is formed for manual engagement and displacement in assisting the movement of fece 21 onto the fece-receiving area 18. Member 31 is adapted for use with a covering disposable sheet 32 which after use may be deposited on area 18 for containment with the fece 21 within the interior of bag 17 for convenient, clean and sanitary transporting and disposal. Preferably, sheet 32 may be provided in the form of a bag dimensioned to receive and cover pusher member 31.

Preferably, pusher member 31 is formed with a handle portion 33 adjacent one end and is adapted for insertion of its opposite end 34 into bag 32 providing the disposable sheet aforementioned; and pusher member 31 is dimensioned for mounting on and providing a top for trough-like member 11 and is provided with mounting portions 36 and 37 engageable in side openings 22 and 23 to provide a demountable assembly, as illustrated in FIGS. 1 through 4. Structurally, pusher member 31 may be formed as a semi-rigid sheet, e.g. plastic, having a return folded portion 41 defining handle 33 and having a length sufficient to overlie the majority of length of member 11. As here shown, the return folded portion 41 is formed with laterally projecting ears providing the mounting portions 36 and 37 and which are formed for hinged engagement in side openings 22 and 23. Member 11 may be similarly formed of semi-rigid sheet material to provide a bottom wall 42 and opposed sides 12 and 13. Additionally, member 11 is formed with a bag storage compartment 43 remote from its open end 26 and which is formed with withdrawal slots 46 and 47 for bags 17 and 32. Compartment 43 may be conveniently formed as here shown by looping wall 42 back and upon itself to provide a closed end wall 48, a top wall 49, and an interior wall 50. By forming the member and particularly compartment walls 48–50 of semi-rigid resilient sheet material, interior wall 50 may be elevated from bottom wall 42 so as to open compartment 43 for insertion of stacks of bags 17 and 32, the latter being preferably interfolded to provide for their serial release upon withdrawal from slots 46 and 47, here formed in walls 49 and 42. With member 31 assembled on member 11, as seen in FIGS. 1–4, an open compartment 52 is formed between the interior wall 50 of compartment 43 and the handle portion 33 of member 31. This compartment may be conveniently used to store a closed fece-loaded bag in a completely concealed condition from the point of pick up to disposal of the bag and contained fece.

Figure 2:
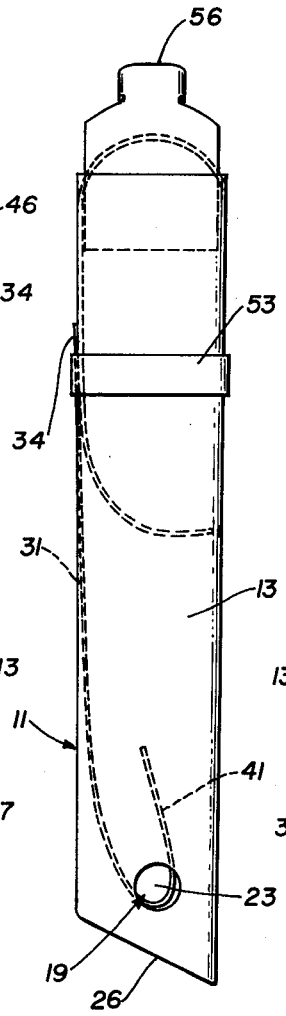
FIG. 2 is a side elevation of the device.
Figure 3:
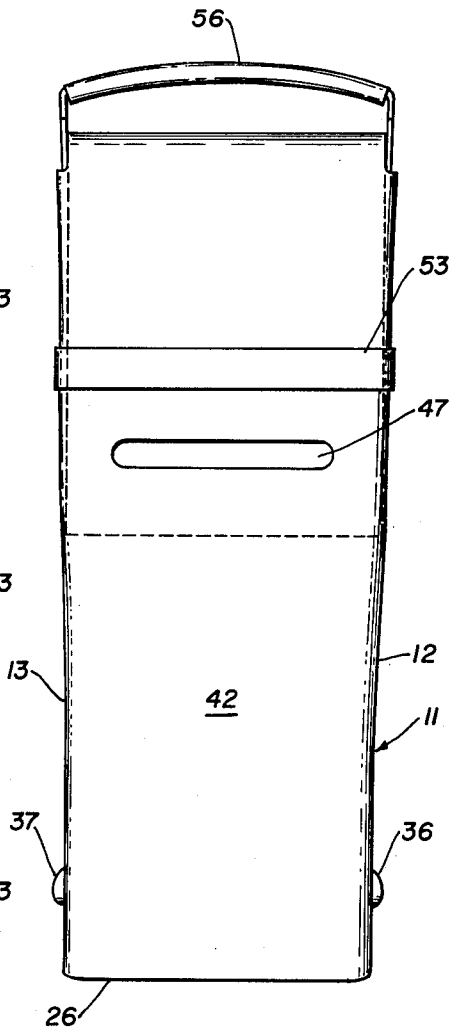
FIG. 3 is a rear elevation of the device.
Figure 4:
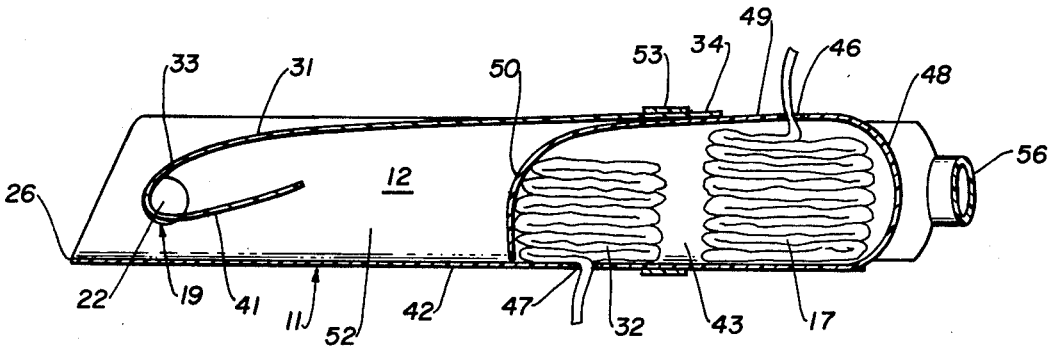
FIG. 4 is a longitudinal cross-sectional view taken substantially on the plane of line 4—4 of FIG. 1.

Retention of member 31 on member 11 completing the compact assembly, as illustrated, is here effected by a band 53 surrounding and slidably mounted on member 11 for selectively enclosing end 34 of the pusher member. With reference to the drawings, band 53 will be pushed upwardly, as seen in FIGS. 1–3 to release the pusher member or will be slipped downwardly over end 34 to retain the pusher member. Ears 36 and 37 of the pusher member may be readily removed from or inserted into openings 22 and 23 by springing apart of sides 12 and 13. In its assembled position, as seen in FIGS. 1–4, member 31 will rest at its distal end 34 upon top wall 49 of compartment 43 and be retained thereon by band 53.

To complete the assembly, a handle strap 56 is here connected to sides 12 and 13 spanning the end of the device adjacent but spaced from bag storage compartment 43 so as to afford manual engagement for carrying the device in its assembled position. As will be observed, the device, as herein constructed and assembled, provides a compact readily portable and attractive structure for carrying about by the user, as for example in walking the pet, and in carrying a fece-loaded bag to a waste container for disposal.

As will be clear from the foregoing, no portion of the device need ever be brought in contact with the fece being picked up, and the latter may be readily transferred to the interior of a disposable bag, such as the common polyethylene bag, without ever being touched by the user or any permanent portion of the device. Due to the concave form of the fece-receiving area 18, and the relatively elevated sides 12 and 13, the open end of bag 17 upon being rolled back, will be supported by the raised sides clear of the fece deposited on area 18, and the fece thus automatically located within the interior of the bag. Other than the interior side of bag 17, contact with the fece is exclusively confined to disposable bag 32 covering the pusher member 31 and which is deposited with the fece within the interior of bag 17. Normally, bag 17 will, after deposit of the fece and bag 32 therein, be closed with a common tie and optionally mounted within compartment 52 for transportation to a trash container or deposited in a trash container if one is close at hand.

What is claimed is:

1. A pet feces pick up device comprising:

a trough-like member having a concave wall and an unobstructed open end attached for insertion into the open end of a pliable disposable bag, said wall being unobstructed at its internal and external sides at said open end and over a length thereof contiguous to said end;

said bag having a length extending over said wall length and a width foldable into conforming shape with said wall to provide an internal lining thereof forming a concave feces-receiving area extending substantially over said wall length; and means on said member adjacent its said open end for securing a mid-length portion of said bag to said member, said means retaining said mid-length bag portion while said open bag end is engaged and rolled back upon itself to an inverted position thus containing feces deposited on said area internally within said bag.

2. The device of claim 1, said means comprising finger-size openings formed in said wall for frictionally retaining bag portions pushed into said openings.

3. The device of claim 2, and a plate-like pusher member formed for manual engagement and displacement in assisting movement of fece to said area;

said pusher member having a handle portion adjacent one end and being adapted for insertion of an opposite end into a bag providing a disposable covering to be deposited after use on said area; and said pusher member being dimensioned for mounting on and providing a top for said trough-like member and being formed with mounting portions engageable in said wall openings.

4. The device of claim 3, said trough-like member having a bag storage compartment remote from its open end and formed with withdrawal slots for bags mounted in said compartment and dimensioned for mounting on said members.

5. The device of claim 4, said members cooperating to define a second storage compartment between said first-named compartment and said handle portion.

6. The device of claim 5, said pusher member comprising a semi-rigid sheet having a return-folded portion defining said handle portion and having a length positioning its opposite end into overlying support on said compartment;

said return-folded portion being formed with laterally projecting ears dimensioned for hinged engagement in said wall openings;

a band surrounding and slidably mounted on said trough-like member for selectively enclosing said opposite end of said pusher member and retaining said members in assembled position.

7. The device of claim 6, and a handle strap spanning and connected to said wall at its end opposite to said open end and being spaced from said compartment to afford manual engagement for carrying said device in its assembled position.

* * * * *

UNITED STATES PATENT AND TRADEMARK OFFICE

CERTIFICATE OF CORRECTION

PATENT NO. : 4,243,259

DATED : January 6, 1981

INVENTOR(S) : Ralph J. Wright assigned to Rita Dixon

It is certified that error appears in the above-identified patent and that said Letters Patent are hereby corrected as shown below:

Col. 2, line 20, after "plate-like" insert ---pusher---.

Signed and Sealed this

*Fourteenth* Day of *April 1981*

[SEAL]

*Attest:*

RENE D. TEGTMEYER

*Attesting Officer* *Acting Commissioner of Patents and Trademarks*